US011885571B2

(12) United States Patent
Cheng

(10) Patent No.: US 11,885,571 B2
(45) Date of Patent: Jan. 30, 2024

(54) PULSATING VAPOR CHAMBER

(71) Applicant: COOLER MASTER CO., LTD., New Taipei (TW)

(72) Inventor: Jen-Chih Cheng, New Taipei (TW)

(73) Assignee: Cooler Master Co., Ltd., New Taipei (TW)

( * ) Notice: Subject to any disclaimer, the term of this patent is extended or adjusted under 35 U.S.C. 154(b) by 22 days.

(21) Appl. No.: 17/105,101

(22) Filed: Nov. 25, 2020

(65) Prior Publication Data

US 2021/0080190 A1 Mar. 18, 2021

Related U.S. Application Data

(62) Division of application No. 16/157,879, filed on Oct. 11, 2018, now Pat. No. 10,883,768.

(60) Provisional application No. 62/572,191, filed on Oct. 13, 2017.

(51) Int. Cl.
*F28D 15/02* (2006.01)

(52) U.S. Cl.
CPC ..... *F28D 15/0266* (2013.01); *F28D 15/025* (2013.01); *F28D 15/0283* (2013.01); *F28D 2015/0216* (2013.01)

(58) Field of Classification Search
CPC ..... F28D 15/0266; F28D 15/025; F28D 15/0283; F28D 15/0216; F28D 2015/0216
USPC ..... 165/104.21
See application file for complete search history.

(56) References Cited

U.S. PATENT DOCUMENTS 5,287,919 A * 2/1994 George ..... A47J 37/1233 165/185
5,697,428 A 12/1997 Akachi
6,536,516 B2 * 3/2003 Davies ..... F28F 3/04 165/170
6,672,373 B2 1/2004 Smyrnov
6,679,316 B1 1/2004 In et al.
6,827,134 B1 12/2004 Rightley et al.
7,025,127 B2 * 4/2006 Wu ..... F28D 1/0308 165/170
8,256,501 B2 9/2012 Nagai et al.
8,919,426 B2 12/2014 Hardesty
(Continued)

FOREIGN PATENT DOCUMENTS

CN 1632441 A 6/2005
CN 101424491 A 5/2009
(Continued)

*Primary Examiner* — Tho V Duong
(74) *Attorney, Agent, or Firm* — Dickinson Wright PLLC

(57) ABSTRACT

A pulsating vapor chamber has an inner board, a first outer board, a second outer board, an asymmetric loop, and a working fluid. The inner board has a first surface and a second surface. The first and second outer boards are mounted on the first surface and the second surface of the inner board respectively. The asymmetric loop is located between the first and second outer boards and has multiple channels communicating with each other in sequence. A part of the channels are formed between the first outer board and the inner board, and the remaining channels are formed between the second outer board and the inner board. With the asymmetric loop, even if the vapor chamber is disposed horizontally, pressure may be changed by different amount in the channels so that the working fluid is still able to oscillate or circulate.

15 Claims, 16 Drawing Sheets

(56) References Cited

U.S. PATENT DOCUMENTS

| | | | | |
|---|---|---|---|---|
| 2008/0087406 | A1* | 4/2008 | Asfia | F28D 15/043 165/104.33 |
| 2010/0242502 | A1 | 9/2010 | Stautner | |
| 2011/0067846 | A1 | 3/2011 | Vasiliev, Jr. | |
| 2013/0133871 | A1* | 5/2013 | Ma | F28D 15/00 165/185 |
| 2015/0136358 | A1* | 5/2015 | Gradinger | H01L 23/427 165/80.3 |

FOREIGN PATENT DOCUMENTS

| | | | | | |
|---|---|---|---|---|---|
| CN | 101487584 | A | | 7/2009 | |
| CN | 101776408 | A | | 7/2010 | |
| CN | 201803624U | U | | 4/2011 | |
| CN | 102062552 | A | * | 5/2011 | F28D 15/0266 |
| CN | 102620586 | A | | 8/2012 | |
| CN | 102620587 | A | | 8/2012 | |
| CN | 102628655 | A | | 8/2012 | |
| CN | 103000737 | A | * | 3/2013 | F28D 15/0266 |
| TW | 270648 | | | 1/2007 | |
| TW | 279899 | | | 4/2007 | |
| TW | 303704 | | | 12/2008 | |
| TW | 307756 | | | 3/2009 | |
| TW | 201116793 | | | 5/2011 | |
| TW | I356672 | | | 1/2012 | |
| TW | I387718 | | | 3/2013 | |
| WO | WO-2016060350 | A1 | * | 4/2016 | F28D 15/0233 |

* cited by examiner

PULSATING VAPOR CHAMBER

CROSS-REFERENCE TO RELATED APPLICATIONS

This application is a divisional of United States non-provisional patent application filed on Oct. 11, 2018 and having application Ser. No. 16/157,879, which is based upon and claims priority under 35 U.S.C. 119 from United States provisional patent application filed on Oct. 13, 2017 and having application Ser. No. 62/572,191, the entire contents of which are hereby incorporated herein by reference.

BACKGROUND OF THE INVENTION

1. Field of the Invention

The present invention relates to a heat transmitting component, especially to a vapor chamber.

2. Description of the Prior Arts

The heat pipe and the vapor chamber is an efficient heat transfer means, which forms a cavity therein and comprises a working fluid in the cavity. The heat pipe and the vapor chamber may define a heated portion and a cooled portion. The heated portion of the heat pipe and the vapor chamber is connected to a heat source, and the cooled portion of the heat pipe and the vapor chamber is connected to a heat sink, such as fins. After the working fluid in the heated portion of the heat pipe and the vapor chamber is heated by the heat source, the working fluid is changed from liquid state to gaseous state. Then, the vaporized working fluid moves to the cooling portion of the heat pipe and the vapor chamber and is cooled by the heat sink, so the vaporized working fluid is transferred back to the liquid state and moves back to the heated portion. With the aforesaid circulation of the working fluid, heat generated by the heat source may be dissipated efficiently.

One type of the heat pipe is the pulsating heat pipe, which comprises a loop therein and a working fluid in the loop. The loop forms multiple direct portions and multiple inverted portions. The direct portions are parallel to each other and two ends of each one of the inverted portion communicate with two direct portions, so a path along the loop is forward and backward alternately. The working fluid forms multiple liquid slugs and multiple vapor plugs, and the liquid slugs and the vapor plugs are separated in the loop. After parts of the pulsating heat pipe are heated, some of the liquid slugs in the direct portions of the loop are transferred to gaseous state and move upward and become a vapor plug or are absorbed by the existing vapor plugs. Then, when the vaporized working fluids are cooled and transferred back to the liquid state, the condensed working fluids form new liquid slugs or are absorbed by the existing liquid slugs.

In this process, pressures of the vapor plugs are changed, alternately larger and smaller in every individual direct portion, so the vaporized working fluids may push the existing liquid slugs to move upward or downward, i.e. to oscillate in every individual direct portion. If heat transmitted to the pulsating heat pipe is huge, which causes the pressures of some vaporized working fluids to be large enough and counteract the pressures of other vaporized working fluids so that the existing liquid slugs in one direct portion move to another direct portion, all of the existing liquid slugs and the vaporized working fluids may move along the loop in the same direction. In other words, the working fluid is circulating in the loop when encountering huge heat.

However, if the aforesaid principle is apply to the vapor chamber and thus forms a pulsating vapor chamber, the loop in the pulsating vapor chamber may be disposed horizontally. Therefore, the pulsating vapor chamber may not start to oscillate or circulate if the loop is disposed horizontally, so the pulsating vapor chamber may not be utilized to a lot of fields. In addition, the device comprising the pulsating vapor chamber should avoid tilting or turning over so the pulsating vapor chamber in said device will not be disposed horizontally, which also restricts devices where said pulsating vapor chamber is mounted on. To overcome the shortcomings, the present invention provides a pulsating vapor chamber to mitigate or obviate the aforementioned problems.

SUMMARY OF THE INVENTION

The main objective of the present invention is to provide a pulsating vapor chamber that may work even the pulsating vapor chamber is disposed horizontally.

The vapor chamber has an inner board, a first outer board, a second outer board, a plurality of paths, and a working fluid. The inner board has a first surface and a second surface opposite each other. The first outer board is mounted on the first surface of the inner board. The second outer board is mounted on the second surface of the inner board. Each one of the paths has a first end and a second end. The first ends of the paths communicate with each other and the second ends of the paths communicate with each other, so that the plurality of paths forming a loop. Each one of the paths comprises a plurality of first channels, a plurality of second channels, and a plurality of holes. The first channels are formed between the first surface of the inner board and the first outer board. The second channels are formed between the second surface of the inner board and the second outer board. The holes are formed through the first surface and the second surface of the inner board. The first channels and the second channels communicate with each other in a staggered manner and the first channels and the second channels communicate with each other via the holes. The working fluid is in the paths.

With aforesaid structure, the loop is asymmetric, even if the vapor chamber of the present invention is disposed horizontally, the channels on the first surface and the second surface of the inner board are at different levels. Therefore, the vaporized liquid at a lower level tend to move to a higher level, so that the pressures at the higher level and the lower level are changed, which makes the working fluid able to oscillate or circulate in the asymmetric loop. Besides, if the asymmetric loop has a large path and a small path communicating with each other, when the working fluid in connecting portions of the large path and the small path is vaporized or condensed, pressure changes in the large path and the small path are different and thereby the working fluid may oscillate or circulate in the asymmetric loop. In addition, if the asymmetric loop has more than three paths, pressures in the paths may not be balanced by themselves, which causes working fluid in the asymmetric loops to keep oscillating or circulating.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
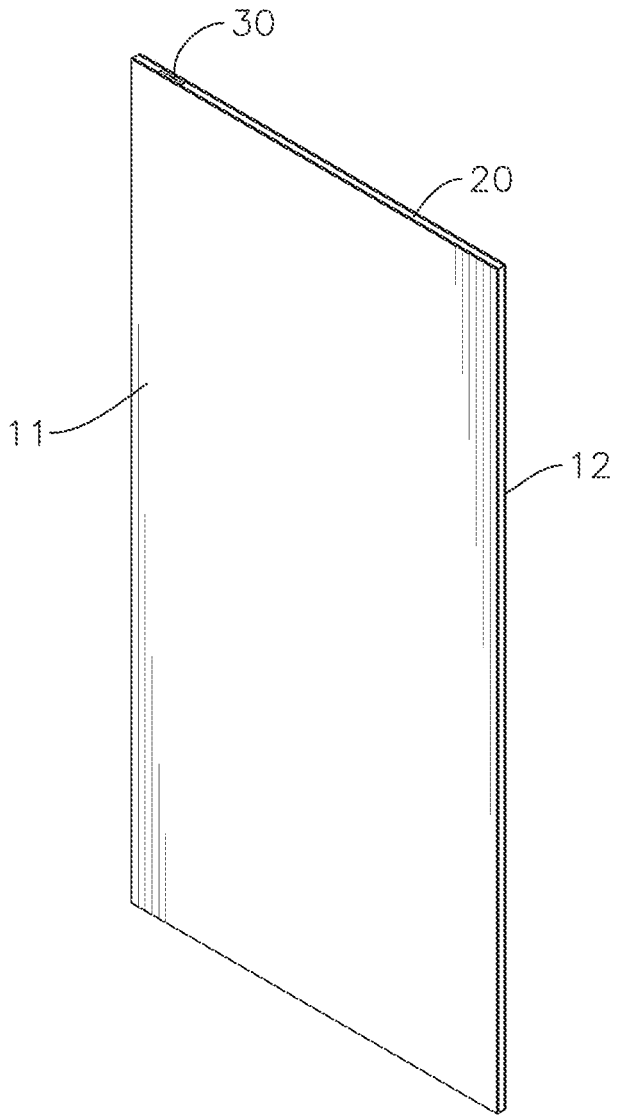
FIG. 1 is a perspective view of a pulsating vapor chamber in accordance with a first embodiment of the present invention.
Figure 2:
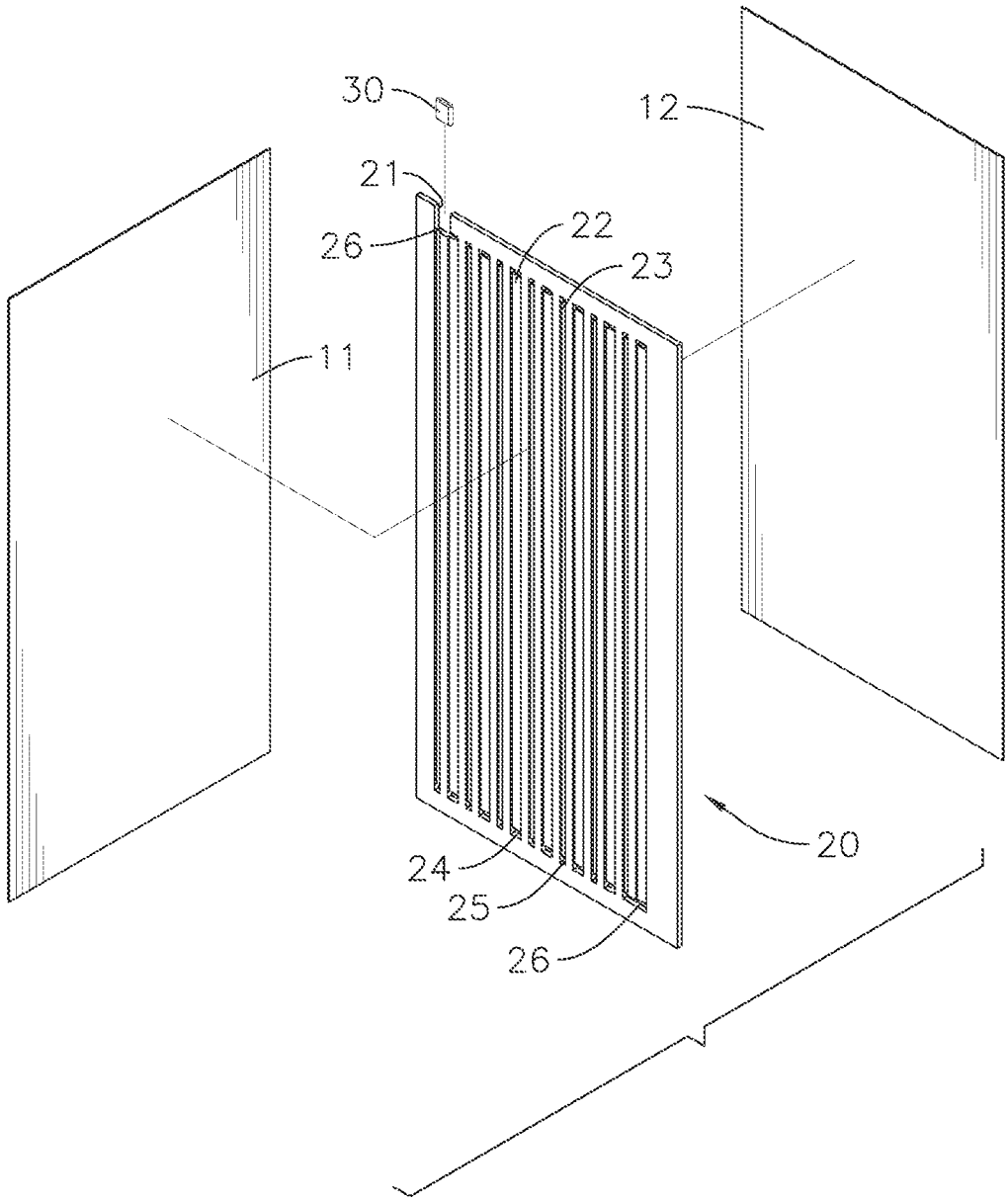
FIG. 2 is an exploded perspective view of the pulsating vapor chamber in FIG. 1.
Figure 3:
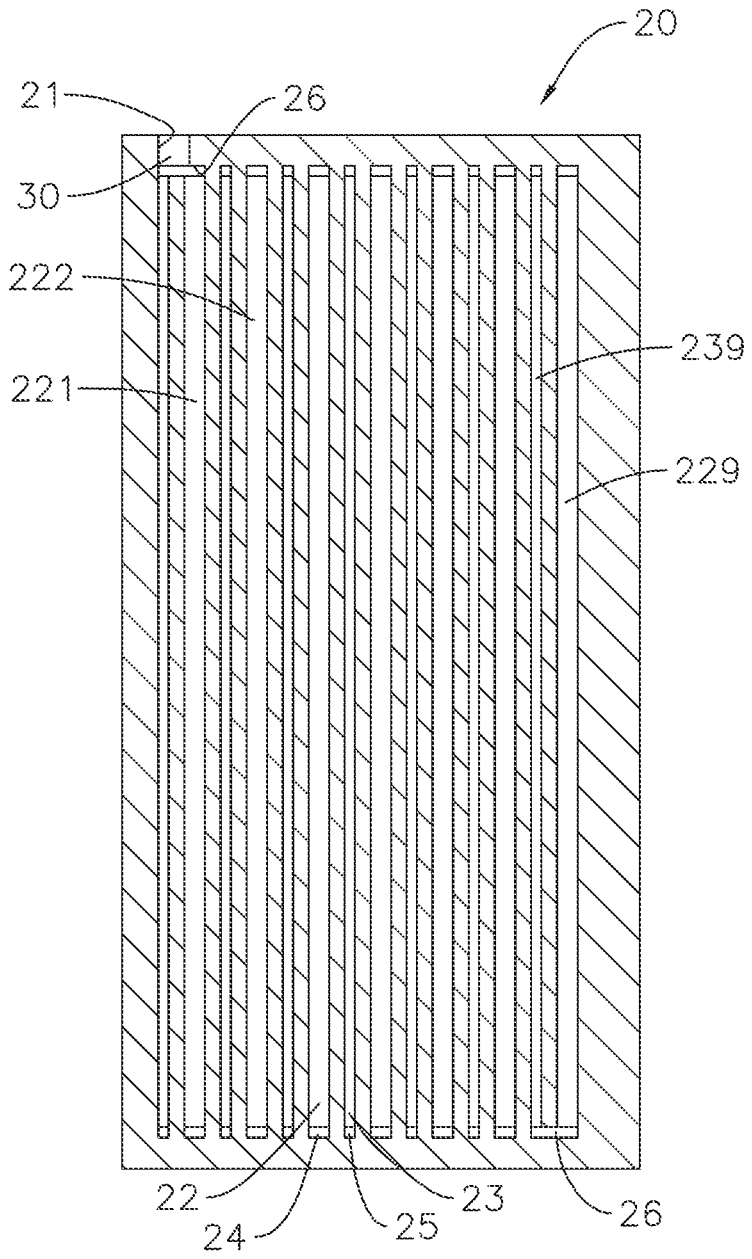
FIG. 3 is a sectional view of the pulsating vapor chamber in FIG. 1.
Figure 4:
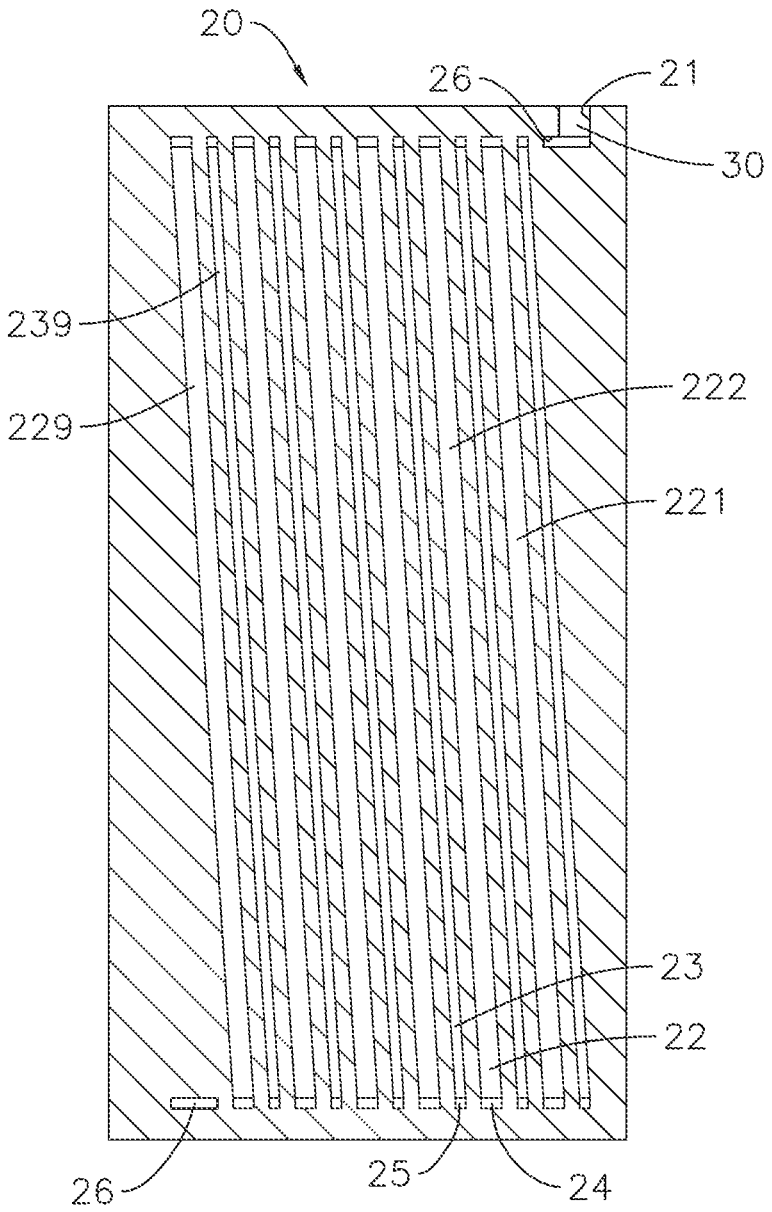
FIG. 4 is another sectional view of the pulsating vapor chamber in FIG. 1.
Figure 5:
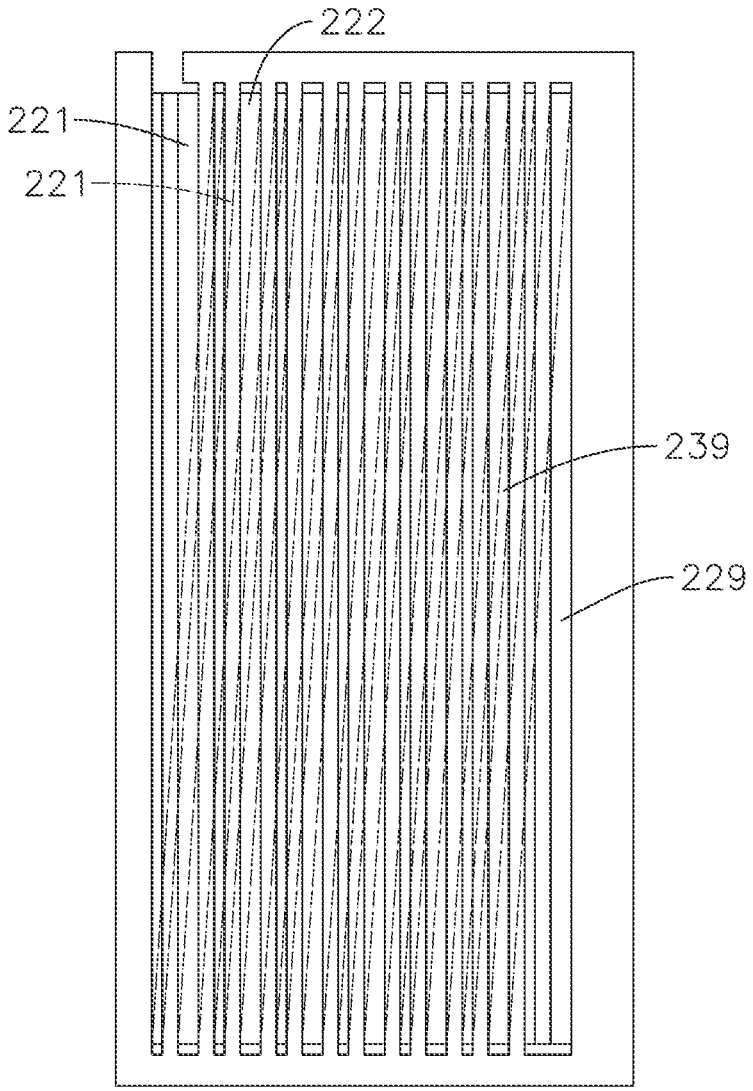
FIG. 5 is a perspective view of the inner board of the pulsating vapor chamber in FIG. 1.
Figure 6:
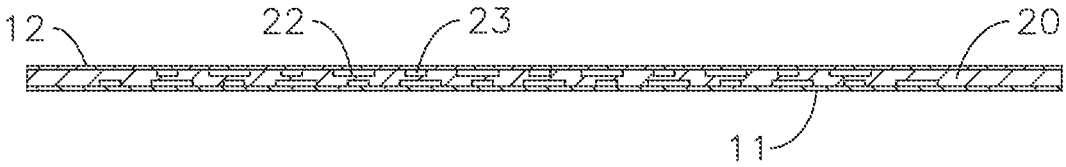
FIG. 6 is still another sectional view of the pulsating vapor chamber in FIG. 1.
Figure 7:
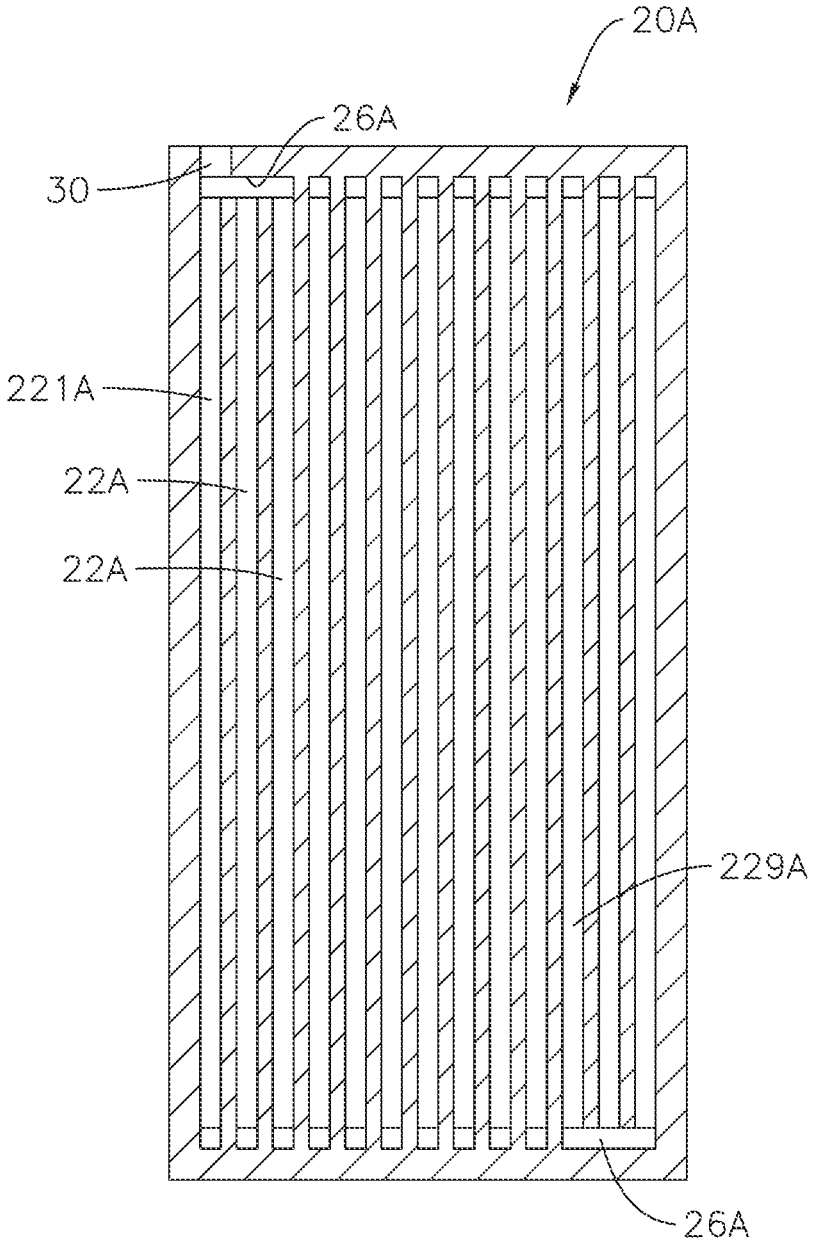
FIG. 7 is a sectional view of a pulsating vapor chamber in accordance with a second embodiment of the present invention.
Figure 8:
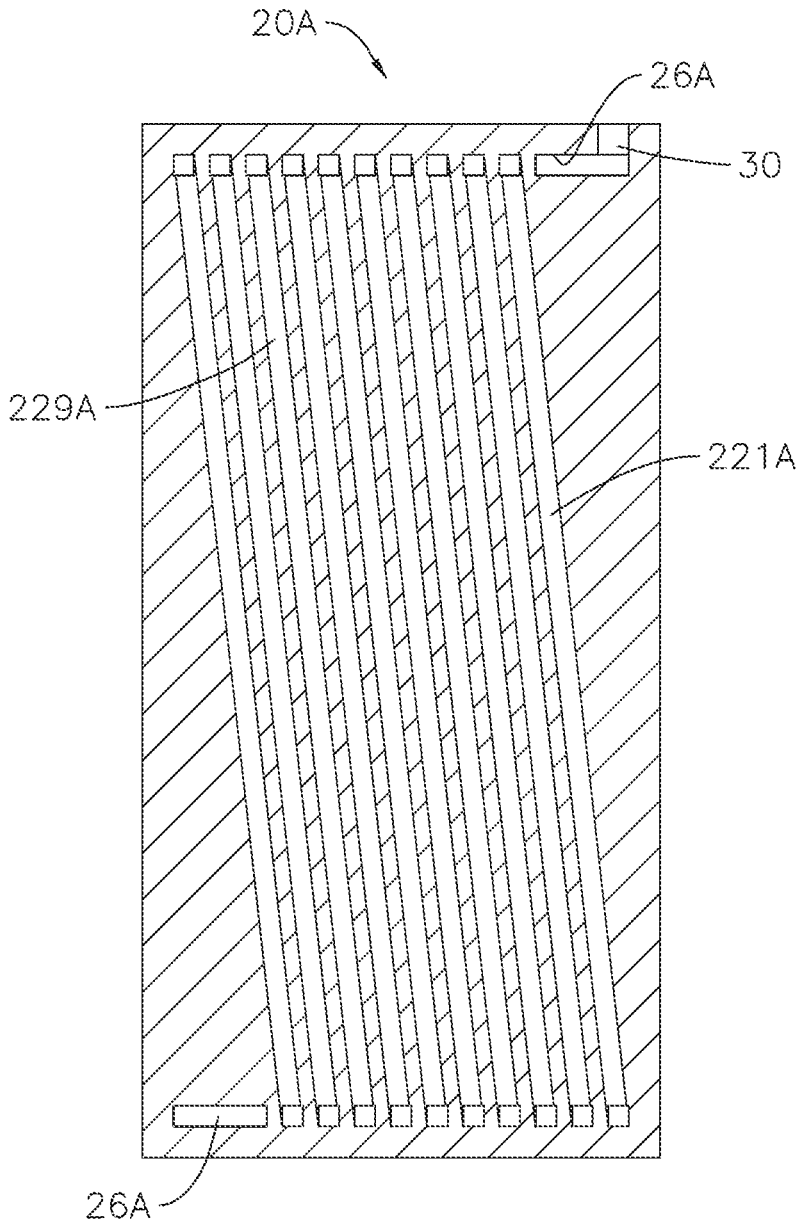
FIG. 8 is another sectional view of the inner board of the pulsating vapor chamber in FIG. 7.
Figure 9:
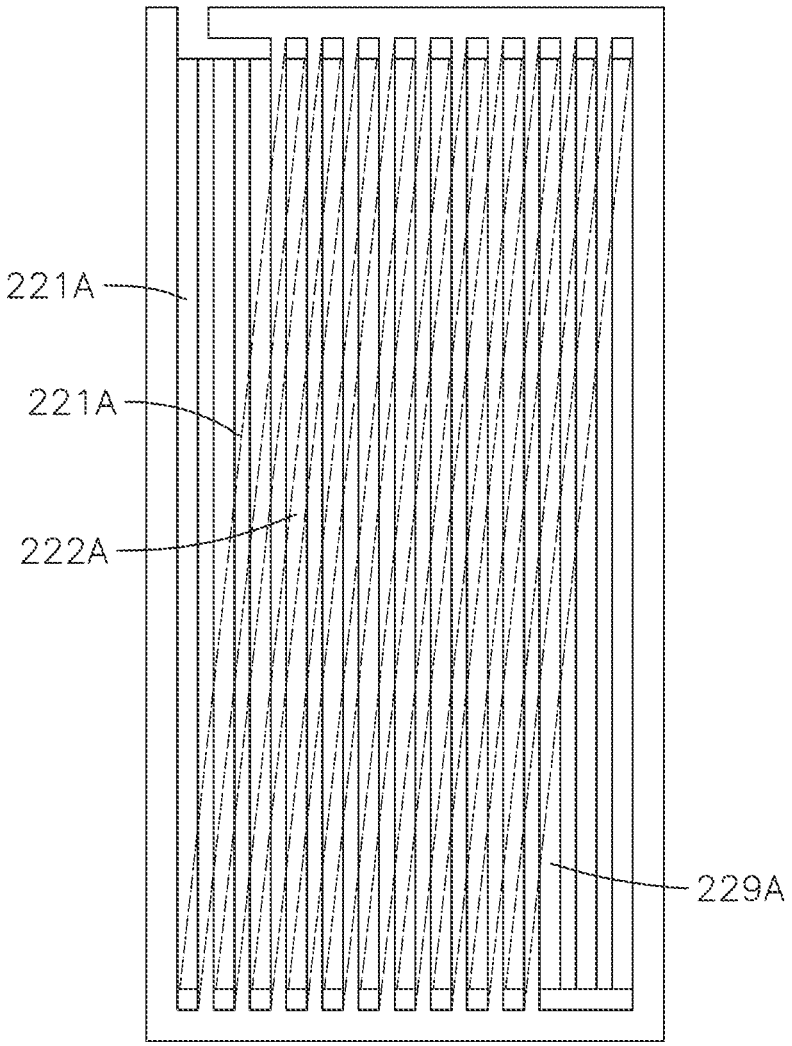
FIG. 9 is a perspective view of an inner board of the pulsating vapor chamber in FIG. 7.
Figure 10:
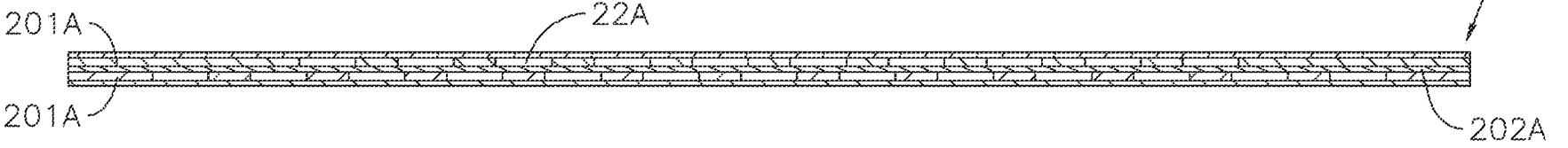
FIG. 10 is still another sectional view of the pulsating vapor chamber in FIG. 7.

An integrated flat plate closed end pulsating vapor chamber (hereinafter referred to as a pulsating vapor chamber) in accordance with the present invention is provided. The pulsating vapor chamber is formed in a plate and the plate forms a heated portion, a cooled portion, and an asymmetric loop. The heated portion is connected to a heat source and the cooled portion is connected to a heat sink. The asymmetric loop is in the plate and comprises a plurality of paths and the paths communicate with each other to form the asymmetric loop. Each one of the paths has an first end and a second end. The first ends of the paths communicate with each other and the second ends of the paths communicate with each other, so that the plurality of paths form the asymmetric loop. The asymmetric loop means that calibers in different parts of the loop may have different sizes (e.g. calibers in different paths are different in size), or a flow way of a working fluid in the loop are not unidirectional.

With reference to FIGS. 1 to 6, in the first embodiment, the plate comprises a first outer board 11, a second outer board 12, an inner board 20, an inlet component 30, and the working fluid (not shown in the drawings). The inner board 20, the inlet component 30, and the paths are located between the first outer board 11 and the second outer board 12. In other words, the first outer board 11 and the second outer board 12 are mounted on two opposite surfaces of the inner board 20.

The inner board 20 forms a first surface and a second surface opposite to each other. The first outer board 11 is mounted on the first surface and the second outer board 12 is mounted on the second surface.

In this embodiment, each one of the paths comprises a plurality of first channels, a plurality of second channels, and a plurality of holes. The first channels are formed between the first outer board 11 and the first surface of the inner board 20. The second channels are formed between the second outer board 12 and the second surface of the inner board 20. The holes are formed through the first surface and the second surface of the inner board 20. The first channels and the second channels communicate with each other in an alternate manner. In other words, between two adjacent said first channels of each one of the paths, there is one said first channel of each remaining path; between two adjacent said second channels of each one of the paths, there is one said second channel of each remaining path.

The first ends of the paths may be formed on the first surface or the second surface of the inner board 20, and the second ends of the paths may be formed on the first surface or the second surface of the inner board 20, too. The first ends and the second ends may be formed on different surfaces, or the first ends of part of the paths are formed on the first surface of the inner board 20 and the first ends of the remaining paths are formed on the second surface of the inner board 20 (and the second ends do as well), but it is not limited thereto.

In this embodiment, one end of one of the outermost first channels of all of the path is defined as the first end and one end of an opposite one of the outermost first channel is defined as the second end. In other words, in this embodiment, both of the first ends of all the paths and the second ends of all the paths are formed on the first surfaces.

Besides, opposite ends of each one of said two outermost first channels communicate with ends of two of the second channels via one of the holes. Except for said two outermost first channels, two ends of each one of the remaining first channels respectively communicate with ends of two of the second channels via one of the holes, and two ends of each one of the remaining second channels respectively communicate with ends of two of the first channels via the holes.

In the first embodiment, the first channels are concaved on the first surface of the inner board 20 and the second channels are concaved on the second surface of the inner board 20, but it is not limited thereto. In another embodiment, the first channels are concaved on the first outer board 11 and the second channels are concaved on the second outer board 12.

In the first embodiment, the asymmetric loop has two paths and the two paths have different sectional areas. In other words, the two paths are defined as a large path and a small path. The channels of the large path are defined as large channels 22, the channels of the small path are defined as small channels 23, the holes communicating with two of the large channels 22 on different surfaces of the inner board 20 are defined as large holes 24, and the holes communicating with two of the small channels 23 on different surfaces of the inner board 20 are defined as small holes 25. The inner board 20 further comprises an opening 21 and two communicating holes 26. The opening 21 is formed on an edge of the inner board 20.

Sectional areas of the small channels 23 are smaller than those of the large channels 22. The large channels 22 and the small channels 23 both are grooves and are formed on the first surface and the second surface. On the first surface, the large channels 22 and the small channels 23 are arranged parallel to each other and also parallel to one edge of the inner board 20. Besides, the large channels 22 and the small channels 23 on the first surface are arranged staggered to each other. On the second surface, the large channels 22 and the small channels 23 are arranged parallel to each other but are oblique with respect to the edge of the inner board 20. However, in another embodiment, both of the large channels 22 and the small channels 23 may be oblique with respect to the edge of the inner board 20. Besides, the large channels 22 and the small channels 23 on the second surface are also arranged staggered to each other.

Numbers of the large channels 22 and the small channels 23 are the same (but it is not limited thereto), and preferred numbers of the large channels 22 and the small channels 23 are more than 3. Besides, the numbers of the large channels 22 and the small channels 23 depend on an area of the plate.

The large holes 24 and the small holes 25 are formed through the inner board 20, and both of the large holes 24 and the small holes 25 are arranged adjacent to two opposite edges of the inner board 20. In other words, the large holes 24 and the small holes 25 are arranged in two lines, the two lines are adjacent to the two opposite edges, and each line has both the large holes 24 and the small holes 25. The large holes 24 and the small holes 25 are also arranged staggered to each other along said adjacent edges, i.e., in each line. Roughly speaking, the two ends of each large channel 22 on the first surface of the inner board 20 communicate with two different large channels 22 on the second surface of the inner board 20, and the two ends of each large channel 22 on the second surface of the inner board 20 also communicate with two different large channels 22 on the first surface of the inner board 20. Precisely, a lower end of a first large channel 221 on the first surface communicates with a lower end of another first large channel 221 on the second surface via one of the large holes 24, an upper end of the first large channel 221 on the second surface communicates with an upper end of another second large channel 222 on the first surface via another one of the large holes 24, a lower end of the second large channel 222 on the first surface communicates with a lower end of another second large channel 222 on the second surface via still another one of the large holes 24, and so on. The technical features of the small channels 23 are almost the same with those of the large channels 22 and one of the differences between the large channels 22 and the small channels 23 is caliber sizes, and another difference is that two of the small channels 23 on different surfaces communicate with each other via one of the small holes 25, so detailed descriptions thereof would be omitted. However, in another embodiment, the caliber sizes of the large channels 22 and the small channels 23 may be the same.

Each one of the two communicating holes 26 is formed through the inner board 20, arranged adjacent to one of said two opposite edges of the inner board 20, and located in one of the lines defined by the large holes 24 and the small holes 25. Besides, one of the two communicating holes 26 communicates with the opening 21 of the inner board 20. Each communicating hole 26 communicates with one of the large channels 22 and one of the small channels 23.

The first ends of the paths communicate with each other via one of the two communicating holes 26; the second ends of the paths communicate with each other via the other one of the two communicating holes 26. In this embodiment, an end of the first large channel 221 on the first surface of the inner board 20 and an end of the first small channel 23 on the first surface of the inner board 20 communicate with each other via one of the communicating holes 26. However, in another embodiment, the communicating hole 26 may communicate with the first large channel 221 and the first small channel 23 which are both on the second surface or on different surfaces, depending on the arrangement of the large channels 22 and the small channels 23.

The other communicating hole 26 communicates with a last large channel 229 and a last small channel 239. In this embodiment, an end of the last large channel 229 on the first surface and an end of the last small channel 239 on the first surface communicate with each other via said the other communicating hole 26. However, in another embodiment, the other communicating hole 26 may communicate with the last large channel 229 and the last small channel 239, which are both on the second surface or on different surfaces, or communicate with upper ends of the last large channel 229 and the last small channel 239 instead, which depends on the arrangement of the large channels 22 and the small channels 23.

Therefore, with the large holes 24, the small holes 25, and the communicating holes 26, the large channels 22 and the small channels 23 are connected and form the asymmetric loop.

The inlet component 30 is a hollow tube originally. One end of the hollow tube is accommodated in the opening 21 of the inner board 20 and between the first and second outer boards 11, 12. The hollow tube communicates with the opening 21, so that the hollow tube communicates with the asymmetric loop formed by the large channels 22 and the small channels 23. Therefore, the working fluid can be poured into the asymmetric loop via the hollow tube, and then the asymmetric loop can be vacuumed to a lower pressure through the hollow tube. After that, a superfluous portion of the hollow tube is cut and a remaining portion of the hollow tube is sealed and thus forms the inlet component 30. In other words, the inlet component 30 seals the opening 21 of the inner board 20.

The working fluid in the asymmetric loop forms a plurality of liquid slugs and a plurality of vapor plugs staggered from each other.

The heated portion and the cooled portion respectively correspond to two ends of the large channels 22 and also respectively correspond to two ends of the small channels 23, so the large channels 22 and the small channels 23 connect the heated portion and the cooled portion and thus heat can be transmitted from the heated portion to the cooled portion.

When the pulsating vapor chamber of the present invention is disposed in a vertical or inclined manner, it works like a conventional pulsating vapor chamber. In other words, part of the heated liquid slugs change to gaseous state and the vaporized liquid moves upward and becomes a new vapor plug or is absorbed by one of the existing vapor plugs. Therefore, the pressures of the vapor plugs are changed and push the remaining liquid slugs to circulate or move up and down.

When the pulsating vapor chamber of the present invention is disposed horizontally, because the large channels 22 and the small channels 23 are formed on the first surface and the second surface of the inner board 20, the large channels 22 and the small channels 23 are disposed at two different high levels. Therefore, the vaporized liquid at a lower level tend to move to a higher level, so that the pressures at the higher level and the lower level are changed, which causes the remaining liquid slugs to circulate or move forward and backward between the heated portion and the cooled portion of the plate. Especially, in this embodiment, the two communicating holes 26 are respectively arranged in the heated portion and the cooled portion of the plate, so moving directions of the working fluid are reverse in the communicating holes 26. Precisely, at the heated portion, an amount of increased pressure in the small channel 23 is larger than that in the large channel 22, so the liquid slug may move from the small channel 23 to the large channel 22. On the contrary, at the cooled portion, an amount of decreased pressure in the small channel 23 is larger than that in the large channel 22, so the liquid slug may move from the large channel 22 to the small channel 23.

Thus, with one end of the large channels 22 and the small channels 23 communicating with each other arranged in the heated portion and the other end of the large channels 22 and the small channels 23 communicating with each other arranged in the cooled portion, the changing pressure may push the liquid slug to circulate further, even though the pulsating vapor chamber of the present invention is disposed horizontally.

Please refer to FIGS. 7 to 10. A second embodiment of the present invention is provided. The pulsating vapor chamber of the second embodiment is similar to the pulsating vapor chamber of the first embodiment, but one of the differences is the inner board 20A comprises three paths and calibers of the three paths are of the same size. In the second embodiment, the first channels and the second channels of the each one of the paths are defined as flow channels 22A. Technical features of each one of the paths of the flow channels 22A are similar to the group of the large channels 22 or the small channels 23 of the first embodiment. In another embodiment, number of the paths may be more than three.

Numbers of the flow channels 22A of the three paths may be equal or not equal. In this embodiment, the number of the flow channels 22A of one of the paths is more than the numbers of the flow channels 22A of the remaining paths by one.

The flow channels 22A in each path are formed on the first surface and the second surface of the inner board 20A. On the first surface, the flow channels 22A are arranged parallel to each other and also parallel to one edge of the inner board 20A, but it is not limited thereto. On the second surface, the flow channels 22A are arranged parallel to each other but are oblique with respect to the edge of the inner board 20A, but it is not limited thereto. Further, the three paths of the flow channels 22A are arranged in an alternate manner on both the first surface and the second surface.

In every path, a lower end of the first flow channel 221A on the first surface communicates with a lower end of the first flow channel 221A on the second surface, an upper end of the first flow channel 221A on the second surface communicates with an upper end of the second flow channel 222A on the first surface, a lower end of the second flow channel 222A on the first surface communicates with a lower end of the second flow channel 222A on the second surface, and so on.

Another difference between the second embodiment and the first embodiment is that each one of the communicating holes 26A communicates with the three paths. In this embodiment, three upper ends of the first flow channels 22A in the three paths on the first surface communicate with each other via one of the communicating holes 26A and three lower ends of the last flow channels 229A in the three paths on the first surface communicate with each other via the other communicating hole 26A, but it is not limited thereto. In the second embodiment, the inner board 20A may be made by three sheets. One of the sheets is an inner sheet 202A and the remaining two sheets are two outer sheets 201A mounted on two opposite surfaces of the inner sheet 202A. Each one of the outer sheets 201A has a plurality of slits and the slits are formed through the outer sheet 201A, so that the first channels are formed through one of the outer sheets 201A and the second channels are formed through the other outer sheet 201A. After the two outer sheets 201A are mounted on the inner sheet 202A, the three sheets 202A and 201A are combined as a single board, i.e. the inner board 20A. Besides, the holes are formed through the inner sheet 202A and the two outer sheets 201A. In other words, five sheets may be combined to form the pulsating vapor chamber. In another embodiment, the inner board 20A may be made by a single board through etching or cutting for forming grooves, and the grooves form the flow channels 22A.

Therefore, the three paths form the asymmetric loop in the second embodiment.

Figure 11:
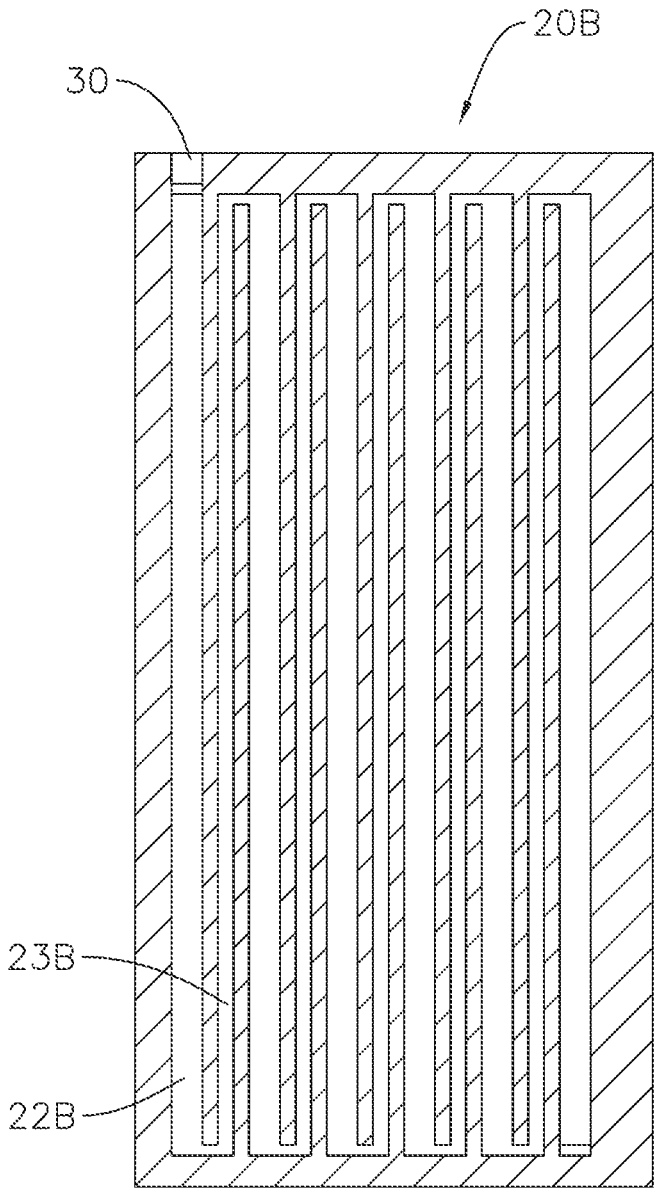
FIG. 11 is a sectional view of a pulsating vapor chamber in accordance with a third embodiment of the present invention.
Figure 12:
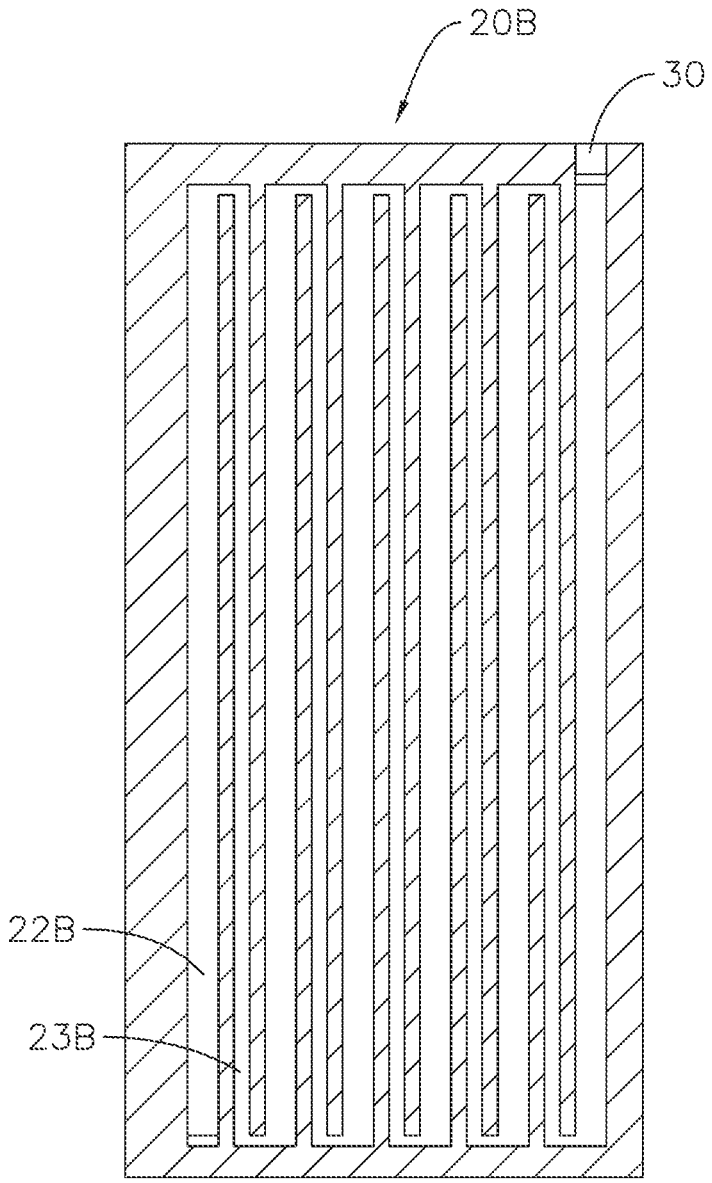
FIG. 12 is another sectional view of the inner board of the pulsating vapor chamber in FIG. 11.
Figure 13:
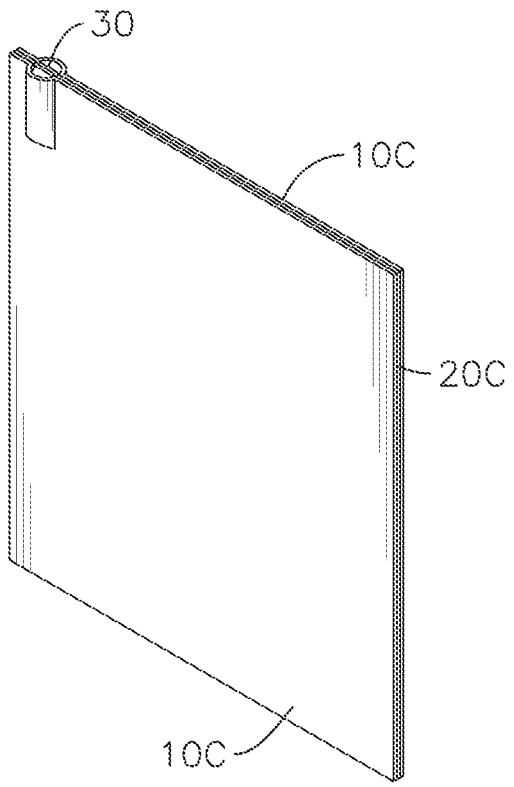
FIG. 13 is a perspective view of a pulsating vapor chamber in accordance with a forth embodiment of the present invention.
Figure 14:
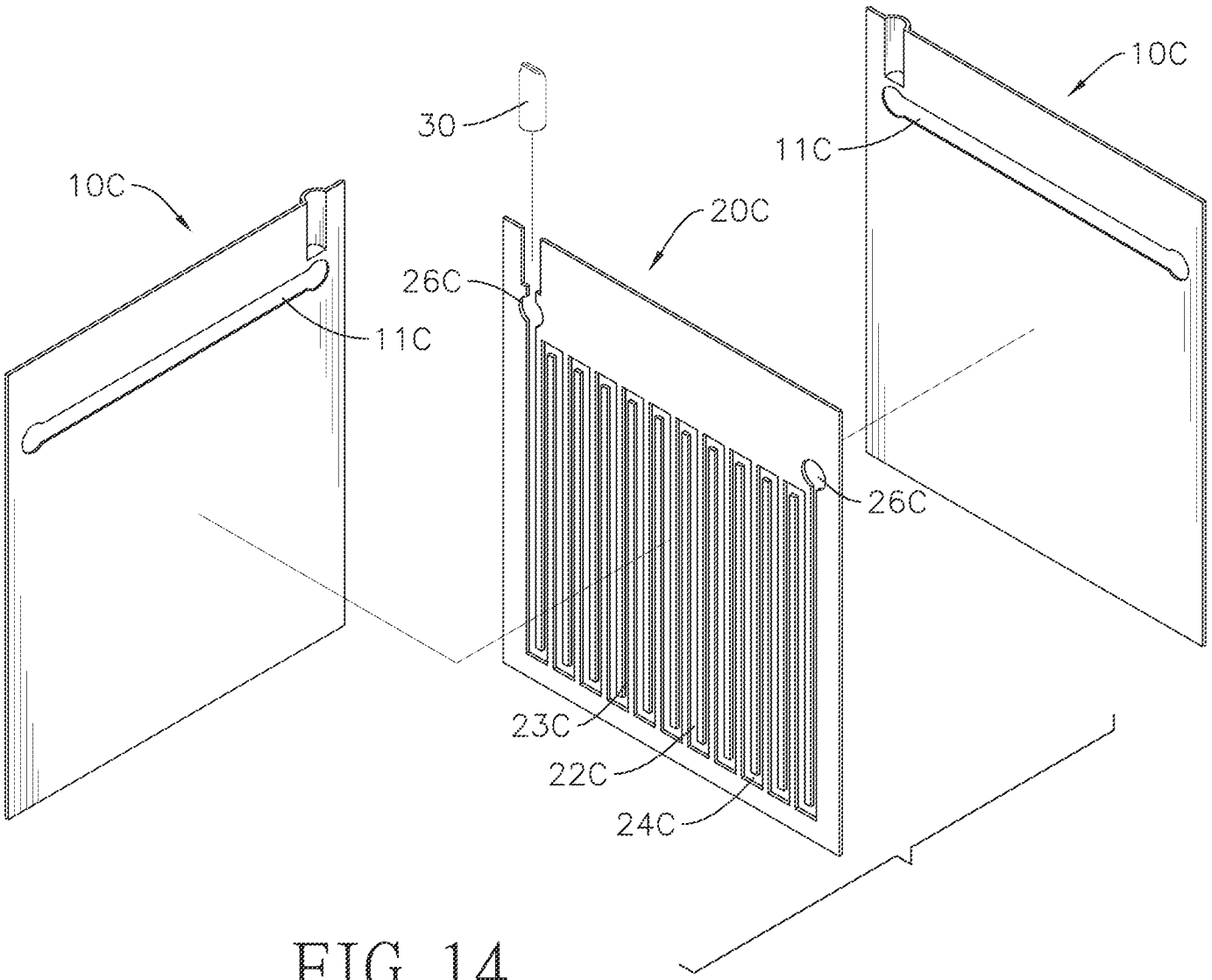
FIG. 14 is an exploded perspective view of the pulsating vapor chamber in FIG. 13.
Figure 15:
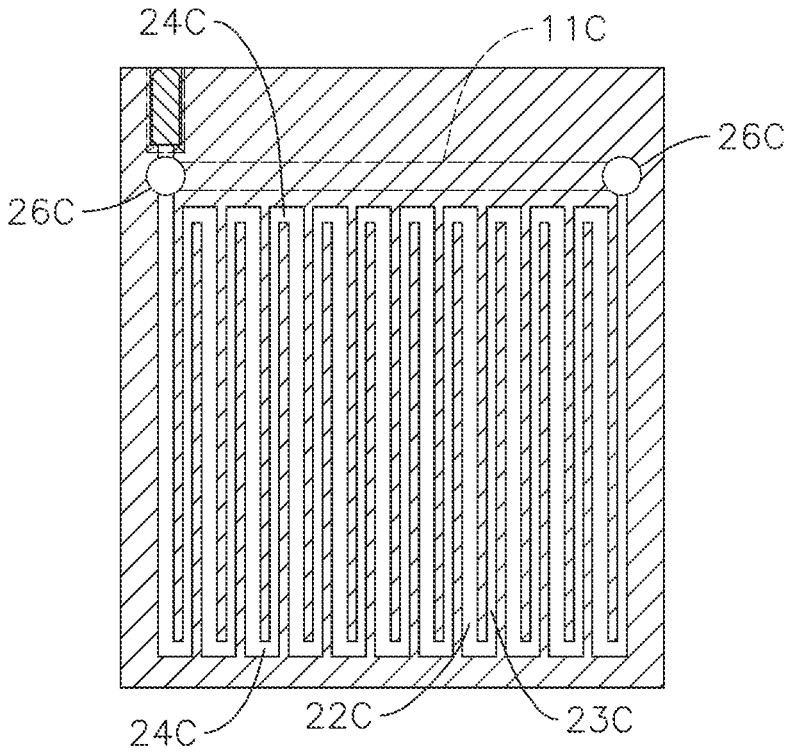
FIG. 15 is a sectional view of the pulsating vapor chamber in FIG. 13.
Figure 16:
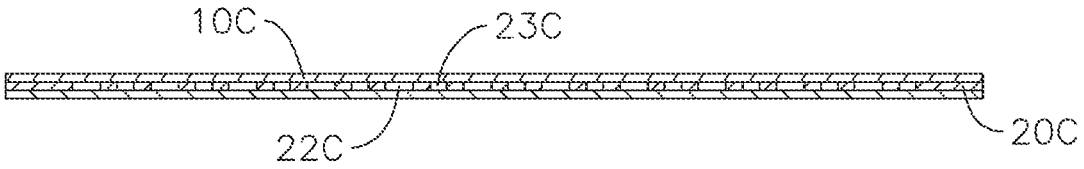
FIG. 16 is another sectional view of the pulsating vapor chamber in FIG. 13.

When the pulsating vapor chamber of the second embodiment is heated, changes of pressures in the three paths may not be the same, so the pressures in the three paths may not be balanced by themselves. In addition, with different numbers of the flow channels 22A in the three paths, the pressures in the three paths may not be balanced by themselves further. Therefore, the working fluid in the asymmetric loop can keep oscillating or circulating and transmitting heat. Please refer to FIGS. 11 and 12. A third embodiment of the present invention is provided. The pulsating vapor chamber of the third embodiment is also a plate forming a heated portion and a cooled portion, and similar to the pulsating vapor chamber of the first embodiment, but one of the differences is the pulsating vapor chamber only have two path and each one of the paths are respectively formed on only one surface of the inner board 20B. Another difference is the pulsating vapor chamber only has two holes formed through the inner board 20B.

Precisely, two ends of one of the paths communicate with two ends of the other one of the paths via the two holes respectively so that the two path form a loop. In the third embodiment, the two holes are located adjacent to two opposite edges of the pulsating vapor chamber, but it is not limited thereto. Each one of the path have a plurality of channels. The caliber sizes of the channels in the two paths may equal or not equal to each other, or the caliber sizes of the channels in the same path may not uniform. In the third embodiment, the channels of each one of the paths are defined as a plurality of large channels 22B and a plurality of small channels 23B. The large channels 22B and the small channels 23B are arranged in a staggered manner. Besides, numbers of the large channels 22B and the small channels 23B may equal or not equal to each other.

Please refer to FIGS. 13 to 16. A fourth embodiment of the present invention is provided. The pulsating vapor chamber of the fourth embodiment is also a plate forming a heated portion and a cooled portion, and similar to the pulsating vapor chamber of the first embodiment, but one of the differences is the large channels 22C and the small channels 23C are not only formed on the first surface and the second surface of the inner board 20C, but formed through the first surface to the second surface of the inner board 20C.

In the fourth embodiment, the inner board 20C has a path formed thought the inner board 20C. The path have aforesaid large channels 22C and small channels 23C. Precisely, each one of the large channels 22C is substantially a large slit forming through the inner board 20C and each one of the small channels 23C is substantially a small slit forming through the inner board 20C.

The large channels 22C and the small channels 23C are arranged staggered and parallel with each other. Therefore, each large channel 22C communicate with two adjacent ones of the small channels 23C, and each small channel 23C communicate with two adjacent ones of the large channels 22C as well.

Precisely, a lower end of the first large channel 22C communicates with a lower end of the first small channel 23C, an upper end of the first small channel 23C communicates with an upper end of the second large channel 22C, a lower end of the second large channel 22C communicates with a lower end of the second small channel 23C, and so on.

Furthermore, the pulsating vapor chamber has a plurality of connecting portions 24C, some of the connecting portions 24C are in the heated portion and the remaining connecting portions 24C are in the cooled portion. Each one of the connecting portions 24C is configured to communicate one of the large channels 22C and one of the small channels 23C.

Another difference between the fourth embodiment and the first embodiment is the two communicating holes 26C respectively communicate with one of the large channel 22C and one of the small channel 23C. In other words, one of the communicating hole 26C communicates with one of the large channels 22C and the other communicating hole 26C communicates with one of the small channels 23C. Precisely, both the communicating holes 26C may communicate with the same ends of the large channel 22C and the small channel 23C, i.e. both upper ends or both lower ends.

In this embodiment, one the communicating hole 26C communicates with an upper end of the large channels 22C and the other communicating hole 26C communicates with an upper end of the small channels 23C.

Another difference between the fourth embodiment and the first embodiment is that the pulsating vapor chamber has at least one communicating channel 11C formed between the inner board 20C and one of the outer board 10C. Precisely, the communicating channel 11C is formed on an inner surface of the corresponding outer board 10C, and two ends of the communicating channel 11C communicate with the two communicating holes 26C. The communicating channel 11C may be a groove concaved on the inner surfaces of the corresponding outer board 10C. In this embodiment, each one of the two outer board 10 comprises one communicating channel 11C.

In another embodiment, the communicating channel may not form on the outer board, but formed on the inner board. Precisely, the communicating channel may be a groove on a side surface of the inner board, or a slit form through the inner board.

With the aforesaid structure, the communicating channels 11C, the communicating holes 26, the large channels 22C (i.e. the large channels), and the small channels 23C (the small channels) are connected and form the loops. In another embodiment, the inner board 20C may not form communicating holes, so the communicating channels 11C communicate with the large channels 22C and the small channels 22C directly.

When the heated portion is heated, an amount of increased pressures in the small channels 23C are larger than that in the large channels 22C, so the liquid slug may move from the small channels 23C to the large channels 22C through the corresponding connecting portions 24C between said large channels 22C and said small channels 23C. On the contrary, when the cooled portion is cooled, an amount of decreased pressures in the small channels 23C are larger than that in the large channels 22C, so the liquid slug may move from the large channels 22C to the small channels 23C through the corresponding connecting portions 24C between said large channels 22C and said small channels 23C. Therefore, the pulsating vapor chamber is easy to oscillate or circulate with different amount of changes between the large channels 22C and the small channels 23C even though the pulsating vapor chamber is disposed in horizontal.

In another embodiment, sectional areas of the channels of the path may be the same, but the communicating channel(s) 11C should concaved on the outer board(s), so that the channels of the path and the communicating channel(s) 11C are located at different levels.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

The invention claimed is:

1. A pulsating vapor chamber comprising:
an inner board having
a first surface, and
a second surface opposite the first surface;
a first outer board mounted on the first surface of the inner board;
a second outer board mounted on the second surface of the inner board;
a path formed between the first outer board and the second outer board, the path comprising a first end and a second end, the path extending between the first end and the second end;
a communicating channel formed between the first outer board and the second outer board, the communicating channel comprising a third end and a fourth end, the communicating channel extending between the third end and the fourth end;
a first hole formed through the first surface and the second surface of the inner board, the first hole communicating with the first end of the path;
a second hole formed through the first surface and the second surface of the inner board, the second hole communicating with the second end of the path; and
a working fluid in the path,
wherein the third end of the communicating channel communicates with the first end of the path, and the fourth end of the communicating channel communicates with the second end of the path.

2. The pulsating vapor chamber as claimed in claim 1, wherein the path is formed through the inner board, or on the inner board.

3. The pulsating vapor chamber as claimed in claim 1, wherein the communicating channel comprises a groove concaved on any or all of a first inner surface of the first outer board, a second inner surface of the second outer board, the first surface of the inner board, and the second surface of the inner board.

4. The pulse vapor chamber of claim 1, wherein the communicating channel is formed between the inner board and one or both of the first outer board and the second outer board.

5. The pulse vapor chamber of claim 4, wherein
the communicating channel is formed on any or all of an inner surface of the first outer board, an inner surface of the second outer board, the first surface of the inner board, and the second surface of the inner board, and the third end of the communicating channel communicates with the first hole and the fourth end of the communicating channel communicates with the second hole.

6. The pulse vapor chamber of claim 5, wherein the communicating channel comprises a groove concaved on any or all of the inner surface of the first outer board, the inner surface of the second outer board, the first surface of the inner board, and the second surface of the inner board.

7. The pulsating vapor chamber as claimed in claim 1, wherein the path comprises:

a plurality of first channels formed through the first surface to the second surface of the inner board; and a plurality of second channels formed through the first surface to the second surface of the inner board.

8. The pulsating vapor chamber as claimed in claim 7, wherein each of said plurality of first channels comprises a first slit through the inner board; and each of said plurality of second channels comprises a second slit through the inner board.

9. The pulsating vapor chamber as claimed in claim 7, wherein the path comprises:

a large path, the first channels being of the large path and defined as large channels; and a small path, the second channels being of the small path and defined as small channels, and sectional areas of the small channels are smaller than those of the large channels.

10. The pulsating vapor chamber as claimed in claim 7, wherein the plurality of the first channels and the plurality of the second channels are arranged in a staggered manner and the plurality of the first channels and the plurality of the second channels communicating with each other.

11. The pulsating vapor chamber as claimed in claim 9, wherein the plurality of the first channels and the plurality of the second channels are arranged in a staggered manner and the plurality of the first channels and the plurality of the second channels communicating with each other, and each of the large channels communicates with two adjacent ones of the small channels, and each small channels communicate with two adjacent ones of the large channels.

12. The pulsating vapor chamber as claimed in claim 11, wherein the staggered manner arrangement comprises at least:

a lower end of a first of the plurality of the large channels in communication with a lower end of a first of the plurality of the small channels;

an upper end of the first of the plurality of the small channels in communication with an upper end of a second of the plurality of the large channels; and a lower end of the second of the plurality of large channels in communication with a lower end of a second of the plurality of small channels.

13. The pulsating vapor chamber of claim 7, further comprising connecting portions, wherein each of the connecting portions is configured to communicate one of the plurality of the first channels and one of the plurality of the second channels.

14. The pulse vapor chamber of claim 1, wherein the path comprises:

a plurality of first channels formed through the first surface to the second surface of the inner board; and a plurality of second channels formed through the first surface to the second surface of the inner board;

the first hole communicates with one of the first channels; and the second hole communicates with one of the second channels.

15. The pulse vapor chamber of claim 4, wherein the communicating channel comprises a slit through the inner board, and the third end of the communicating channel communicates with the first hole and the fourth end of the communicating channel communicates with the second hole.

* * * * *